US006655864B2

(12) United States Patent
Saito

(10) Patent No.: US 6,655,864 B2
(45) Date of Patent: Dec. 2, 2003

(54) DOT RECORDING APPARATUS

(75) Inventor: Kazuo Saito, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 59 days.

(21) Appl. No.: 09/866,863

(22) Filed: May 30, 2001

(65) Prior Publication Data

US 2002/0012561 A1 Jan. 31, 2002

(30) Foreign Application Priority Data

May 31, 2000 (JP) ..... P.2000-162747
Mar. 26, 2001 (JP) ..... P.2001-087533

(51) Int. Cl.[7] ..... B41J 13/10

(52) U.S. Cl. ..... 400/642; 400/625; 271/188; 271/209

(58) Field of Search ..... 271/188, 209; 400/642, 58, 56, 624, 625

(56) References Cited

U.S. PATENT DOCUMENTS 5,153,663 A * 10/1992 Bober et al. ..... 271/188
5,194,904 A * 3/1993 Ruch ..... 162/269
5,291,227 A * 3/1994 Suzuki ..... 347/104
5,800,076 A * 9/1998 Umeda ..... 271/274
5,805,176 A 9/1998 Saito et al.
6,113,289 A * 9/2000 Saito et al. ..... 347/41
6,183,152 B1 * 2/2001 Kumai et al. ..... 101/222
6,503,011 B2 * 1/2003 Kono ..... 400/646
6,561,606 B1 * 5/2003 Yoshida ..... 347/8

FOREIGN PATENT DOCUMENTS

EP 0 728 589 A2 8/1996
EP 0 783 977 A2 7/1997
EP 0 875 389 A2 11/1998
JP 10-138463 A 5/1998
JP 11-138923 A 5/1999
JP 2000-071532 A 3/2000

* cited by examiner

*Primary Examiner*—Ren Yan
*Assistant Examiner*—Dave A. Ghatt
(74) *Attorney, Agent, or Firm*—Sughrue Mion, PLLC

(57) ABSTRACT

A recording head has a head face on which at least one row of dot forming elements which form dots on a recording medium is arranged in a subscanning direction thereof. A drive feeding roller extends in a main scanning direction of the recording head. A plurality of driven feeding rollers are arranged in the main scanning direction with a predetermined interval, such that the recording medium is nipped between the drive feeding roller and the driven feeding rollers to be fed to the recording head. A plurality of medium regulators are arranged in the main scanning direction with a predetermined interval which is associated with the arrangement of the driven feeding rollers. The medium regulators are opposed to the head face such that top faces define a distance between the recording medium carried thereon and the head face.

18 Claims, 9 Drawing Sheets

DOT RECORDING APPARATUS

BACKGROUND OF THE INVENTION

The present invention relates to a dot recording apparatus for serial printers and the like, and more particularly, to a dot recording apparatus using a dot recording head for recording characters on a recording medium carried on medium regulators which are disposed opposite to the recording head and extending separately from each other in the main scanning direction.

A related dot recording apparatus for an ink-jet printer will be described. A recording head has a plurality of dot forming elements for forming a nozzle row on a head face. The dot forming elements is lined up with a substantially fixed pitch along a subscanning direction, and driven during main scanning to record characters on a recording medium. A plurality of medium regulators is disposed opposite to the head face of the recording head and separated from each other in the main scanning direction. The distance between the recording medium and the dot forming elements is defined by the top faces of the respective medium regulators. A feeding roller is disposed closed to the upstream side of the recording head and formed with a feeding drive roller and driven feeding rollers in combination so as to feed the recording medium toward the recording head while nipping the recording medium therein between. A discharging roller is disposed close to the downstream side of the recording head and used for discharging the recording medium downstream.

Further, the feeding roller is formed with the feeding drive roller having a substantially uniform diameter in the longitudinal main scanning direction and a plurality of driven feeding rollers arranged with a fixed pitch in the main scanning direction. The nipping pressure applied to the recording medium onto the feeding roller is generated by pressing each of the driven feeding rollers against the feeding drive roller by means of the force of springs. Moreover, the discharging roller is formed with discharging drive rollers and driven discharging rollers.

In addition to defining the distance between the recording medium and the dot forming elements, the medium regulators guides valley portions of undulating deformation of a recording medium based on cockling to the space between the medium regulators separated from each other. The cockling is an undulating deformation phenomenon resulting from the elongation of paper as a recording medium that has absorbed ink. In other words, the role of the medium regulators also includes preventing the paper from being brought into contact with the head face and consequently stained with ink as the paper swells toward the recording head face due to the undulating deformation of the paper based on the cockling.

Nevertheless, in spite of the fact that the medium regulators have heretofore been disposed with a predetermined pitch in the main scanning direction, no consideration has been given to the relative position of the driven feeding rollers pressed by the feeding drive roller under the nipping pressure. More specifically, no regulated relation of arrangement has existed between the medium regulators and the driven feeding rollers, and both of them have been disposed in mutually unconnected relative positions.

Therefore, even though the medium regulators are disposed with the predetermined pitch in the main scanning direction together with the formation of a base of cockling between the medium regulators, a cockling interval in the case of cockling of paper has become unstable and there has been a case where the cockling interval voluntarily varies at an integer multiple of the pitch of the medium regulator. When a great cockling interval is produced, the amplitude (height of the cockling) also grows larger and there has been the fear of causing the paper to be stained as it contacts the recording head.

With the structure of pressing paper against the medium regulators by the feeding roller together with the structure of holding down the paper by the driven discharging rollers, it has heretofore been arranged to stabilize the cockling interval, that is, to prevent the paper from greatly swelling toward the recording head face. In the case of a multiple band head, for example, the distance between the feeding roller and the driven discharging rollers becomes greater as the length of the nozzle row increases. The problem in this case is that the effect of stabilizing the cockling interval becomes unsatisfactory and the paper tends to be easily stained.

SUMMARY OF THE INVENTION

An object of the present invention is to provide a dot recording apparatus designed to stabilize a cockling interval to ensure that the fear of staining paper with ink as paper swells toward a recording head face due to cockling is decreased.

In order to achieve the above object, according to the present invention, there is provided a dot recording apparatus, comprising:

- a recording head, having a head face on which at least one row of dot forming elements which form dots on a recording medium is arranged in a subscanning direction thereof;
- a drive feeding roller, extending in a main scanning direction of the recording head;
- a plurality of driven feeding rollers, arranged in the main scanning direction with a predetermined interval, such that the recording medium is nipped between the drive feeding roller and the driven feeding rollers to be fed to the recording head; and
- a plurality of medium regulators, arranged in the main scanning direction with a predetermined interval which is associated with the arrangement of the driven feeding rollers, the medium regulators being opposed to the head face such that top faces of the medium regulators define a distance between the recording medium carried thereon and the head face.

In this configuration, the cockling interval of the paper can be made to substantially coincide with the interval of the relevant medium regulator by the nipping force of the feeding rollers and the relevant medium regulator supporting from below the paper affected by the nipping force. Thus the cockling interval becomes stabilized to suppress the probability of staining the paper with ink due to the swelling of the paper toward the recording head face because of cockling.

Preferably, each of the medium regulators extend in the subscanning direction such that the top faces extend beyond an upstream end of the dot row of the dot forming elements.

In this configuration, it is possible to force the recording medium to cockle as desired before the medium is wetted with ink. Therefore, when ink is landed on the medium to be cockled, the medium has been already cockled in the desired interval which has been predetermined by the medium regulators, so that the cockling interval is further stabilized.

Preferably, the predetermined interval of the medium regulator is 20 mm or more. Although the cockling is hardly produced with an interval less than 20 mm in almost all kinds of paper, setting of the interval between the adjoining medium regulators at 20 mm or greater makes it possible to smoothly generate cockling with the desired cockling interval.

Preferably, the dot recording apparatus further comprises a subregulator, disposed between the respective adjacent medium regulators at an area opposed to a downstream side of the head face to support the recording medium together with the medium regulators.

In this configuration, the force of supporting from below the paper by the relevant subregulators affects the area of the medium regulators positioned further upstream, and this results in decreasing the depth of cockling in the cockling interval forcibly provided. Therefore, the variation of the paper gap in the base portion of cockling can be kept in a smaller range.

Here, it is preferable that a top face of the subregulator is not higher than the top face of the medium regulator. In this configuration, the influence of the primary function of the medium regulators which forces the medium to cockle with a predetermined interval is lowered.

Preferably, the dot recording apparatus further comprises a plurality of discharging roller pairs for discharging the recording medium on which dots are recorded by the recording head. Here, each of the discharging roller pairs and the associated medium regulator are situated on the same line which extends in the subscanning direction. In this configuration, the cockling interval can be further stabilized.

Preferably, two adjacent driven feeding rollers are connected with a shaft which extends in the main scanning direction to form a driven feeding roller unit. Here, each of the medium regulators and a center portion in the main scanning direction of the shaft in each of the driven feeding roller units are situated on the same line which extends in the subscanning direction.

In this configuration, the cockling interval can be stabilized in accordance with the predetermined regularity.

Alternatively, each of the medium regulators and a center portion in the main scanning direction of the associated driven feeding roller are situated on the same line which extends in the subscanning direction.

Still alternatively, each of the medium regulators and a center portion in the main scanning direction of every other driven feeding roller are situated on the same line which extends in the subscanning direction.

In this configuration, the cockling interval can be stabilized in accordance with the predetermined regularity.

Still alternatively, each of the medium regulators and a portion of the associated driven feeding roller, which is shifted from the center portion of the associated driven feeding roller in the main scanning direction, are situated on the same line which extends in the subscanning direction.

In this configuration, the cockling interval can be stabilized in accordance with the predetermined regularity.

Still alternatively, two adjacent driven feeding rollers are connected with a shaft which extends in the main scanning direction to form a driven feeding roller unit. Here, each of the medium regulators and an associated portion between the adjacent driven feeding roller units are situated on the same line which extends in the subscanning direction.

In this configuration, the cockling interval can be stabilized in accordance with the predetermined regularity.

Preferably, the outermost medium regulator is disposed such that a side edge of the recording medium is placed on a substantially center portion in the main scanning direction of the top face thereof.

In this configuration, since a range of forcibly flattening the edge portion of the medium is shortened, a cockling shape similar to that of a mountain portion formed by the medium regulator can be formed on the outermost medium regulator. Namely, the cockling shape can be uniformized over the whole width length of the medium.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
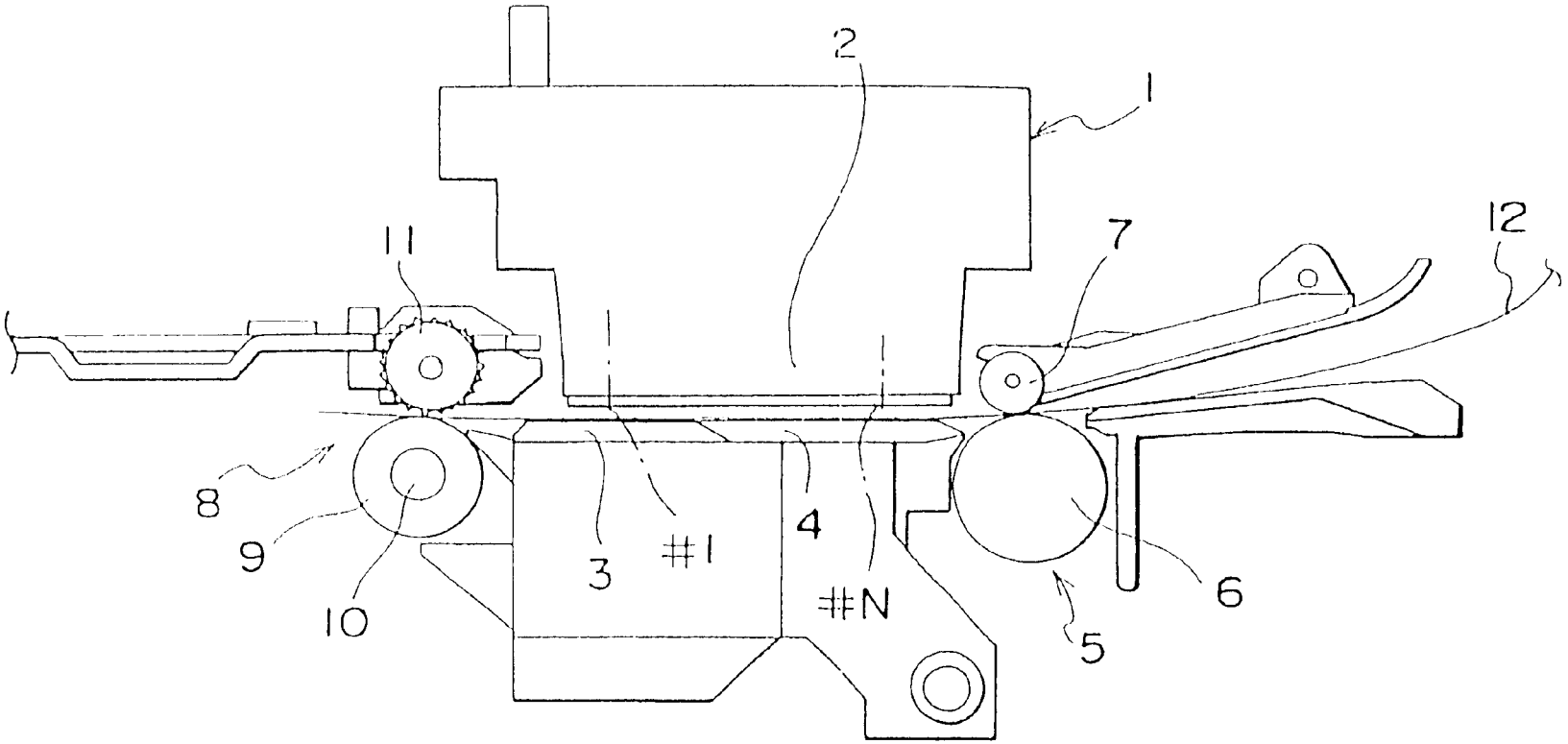
FIG. 1 is a sectional side view of a dot recording apparatus for an ink-jet printer according to a first embodiment of the invention.

A first embodiment of the present invention will now be described with reference to FIGS. 1 to 5.

As shown in these drawings, the dot recording apparatus is provided with a recording head 2 for recording characters on paper 12 provided as a recording medium. The recording head 2 is provided with a plurality of dot forming elements (from #1 to #N) on the head face. The dot forming elements are lined up with a substantially fixed pitch along a subscanning direction as the direction the paper 12 is carried in order to form a nozzle row, and is used to record characters when the dot forming elements (from #1 to #N) are driven in the width direction of the paper 12 during main scanning. Further, the dot recording apparatus is provided with a plurality of medium regulators 4 disposed opposite to the head face of the recording head 2 and separated from each other in the main scanning direction. Top faces of the respective medium regulators, on which the paper 12 is carried, define the distance between on the paper 12 and the dot forming elements (from #1 to #N). The recording head 2 is mounted on a carriage 1.

The top faces of the respective medium regulators 4 are formed into flat faces, which are extended beyond the range of the nozzle row (from #1 to #N) on both upstream and downstream sides.

A feeding roller 5 is disposed closed to the upstream side of the recording head 2. The feeding roller 5 is formed as a combination of a feeding drive roller 6 rotating upon receiving the motive power transmitted from a driving source (not shown) and driven feeding rollers 7 rotating in synchronization with the rotation of the feeding drive roller 6 to feed the paper 12 toward the recording head 2 while nipping the paper 12 therein between.

The feeding drive roller 6 is so structured as to have a substantially uniform diameter in the longitudinal, main scanning direction, and the plurality of driven feeding rollers 7 are arranged with a fixed pitch in the main scanning direction. According to this embodiment, the driven feeding rollers 7 are so configured that a plurality of units each having two driven feeding rollers 7 connected by one shaft 13 are arranged with a fixed pitch in the main scanning direction (37 mm in this embodiment).

The nipping pressure applied to the paper 12 onto the feeding roller 5 is generated by pressing each of the driven feeding rollers 7 against the feeding drive roller 6 by means of the force of springs (not shown) via the shaft 13.

Figure 2:
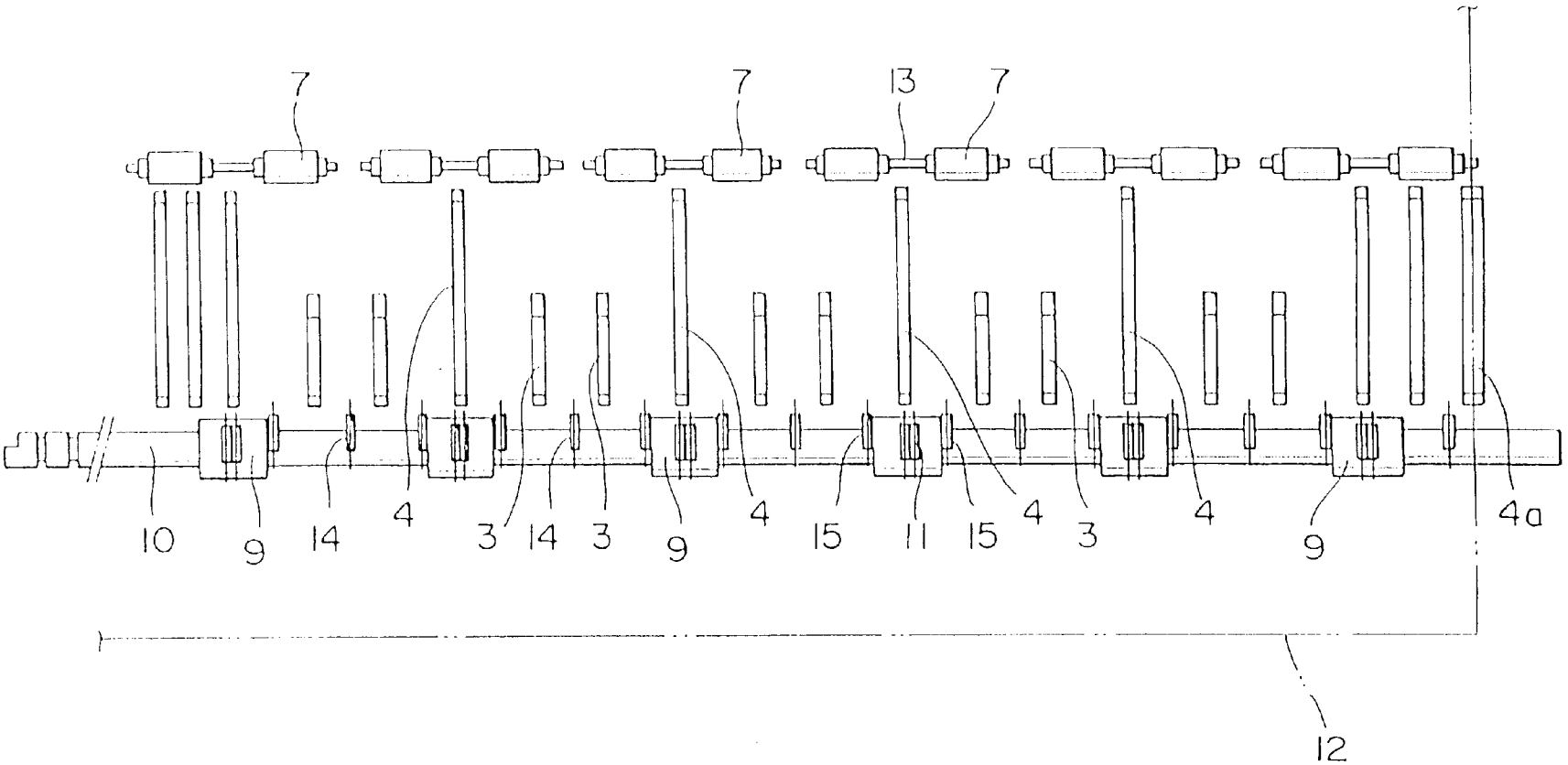
FIG. 2 is a plan view of the essential part of a paper feeding unit of the dot recording apparatus.
Figure 3:
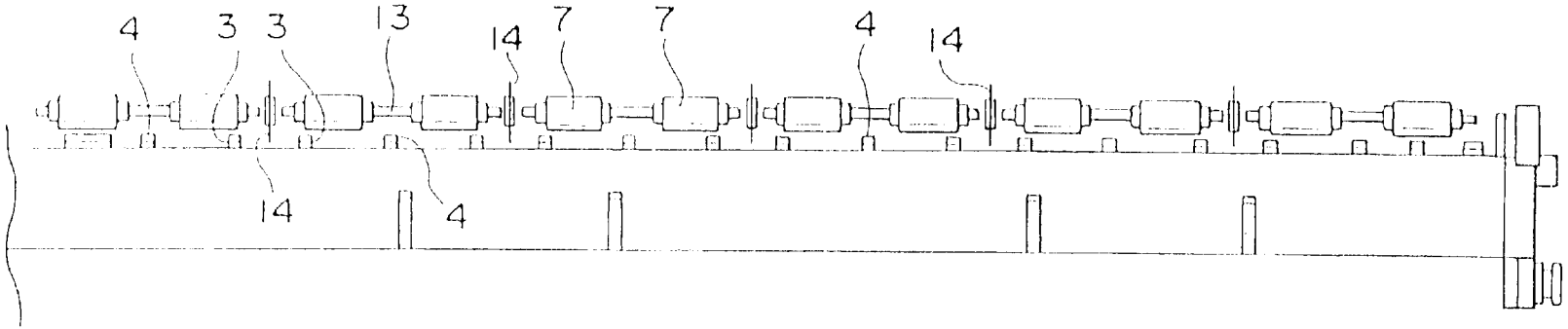
FIG. 3 is a plan view of the essential part of the dot recording apparatus.
Figure 4:
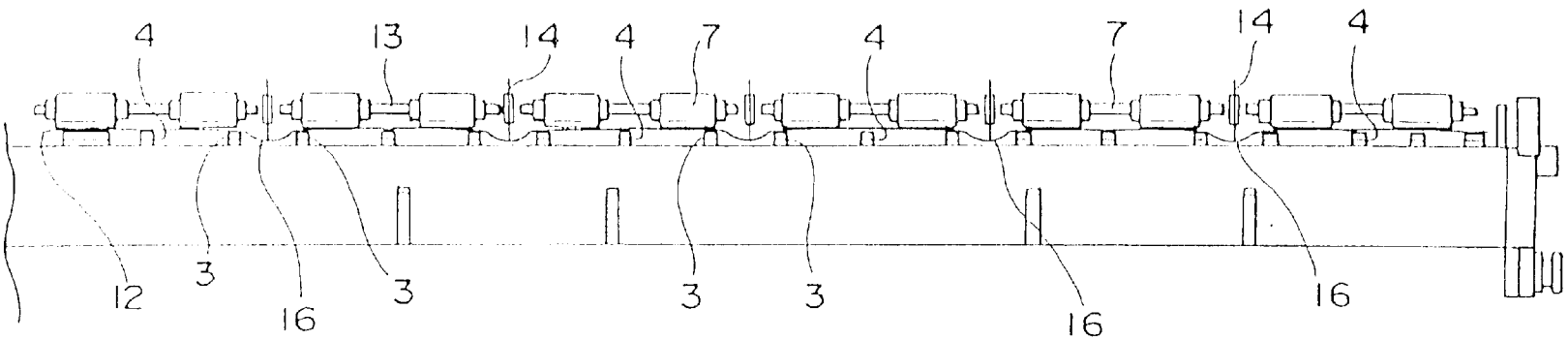
FIG. 4 is a plan view of the essential part of the dot recording apparatus in a paper feeding condition.

A discharging roller 8 is disposed close to the downstream side of the recording head 2. The discharging roller 8 is used to discharge the paper 12 downstream and formed with discharging drive rollers 9 and driven discharging rollers 11. The discharging drive rollers 9 are fitted to a roller shaft 10 receiving the motive power transmitted from a power source (not shown) at fixed intervals as shown in FIG. 2. The driven discharging rollers 11 are isolated from the power source and formed so as to be rotationally driven with the discharging drive rollers 9 in pairs. Reference numeral 14 in FIG. 2 denotes driven discharging rollers mainly for use in keeping the paper 12 from floating upward, and 15 also denotes driven discharging rollers performing the same role as that of the driven discharging rollers 14.

According to the invention, the medium regulators 4 are disposed in such a manner as to have predetermined regularity in the positional relationship of the medium regulators 4 to the respective driven feeding rollers 7. In this embodiment, each of the medium regulators 4 is arranged so that it may be positioned in the central portion of the unit composed of the two driven feeding rollers 7 and the shaft 13. It is preferred to form a space of 20 mm or greater between the adjoining medium regulators 4 and according to this embodiment, a space of 37 mm is formed therein between in order to make this space coincident with the pitch of the relevant unit of the driven feeding roller 7.

Further, subregulators 3 are disposed between the medium regulators 4 in such a position as to be opposed to the downstream side of the range of the nozzle row (from #1 to #N). The height of each subregulator 3 is slightly smaller than that of the medium regulator 4.

As described above, the discharging roller 8 is formed with the discharging drive rollers 9 and the driven discharging rollers 11 and as shown in FIG. 2, each discharging drive roller 9 is disposed so that its position in the main scanning direction may be coincident with that of the medium regulator 4.

Figure 5:
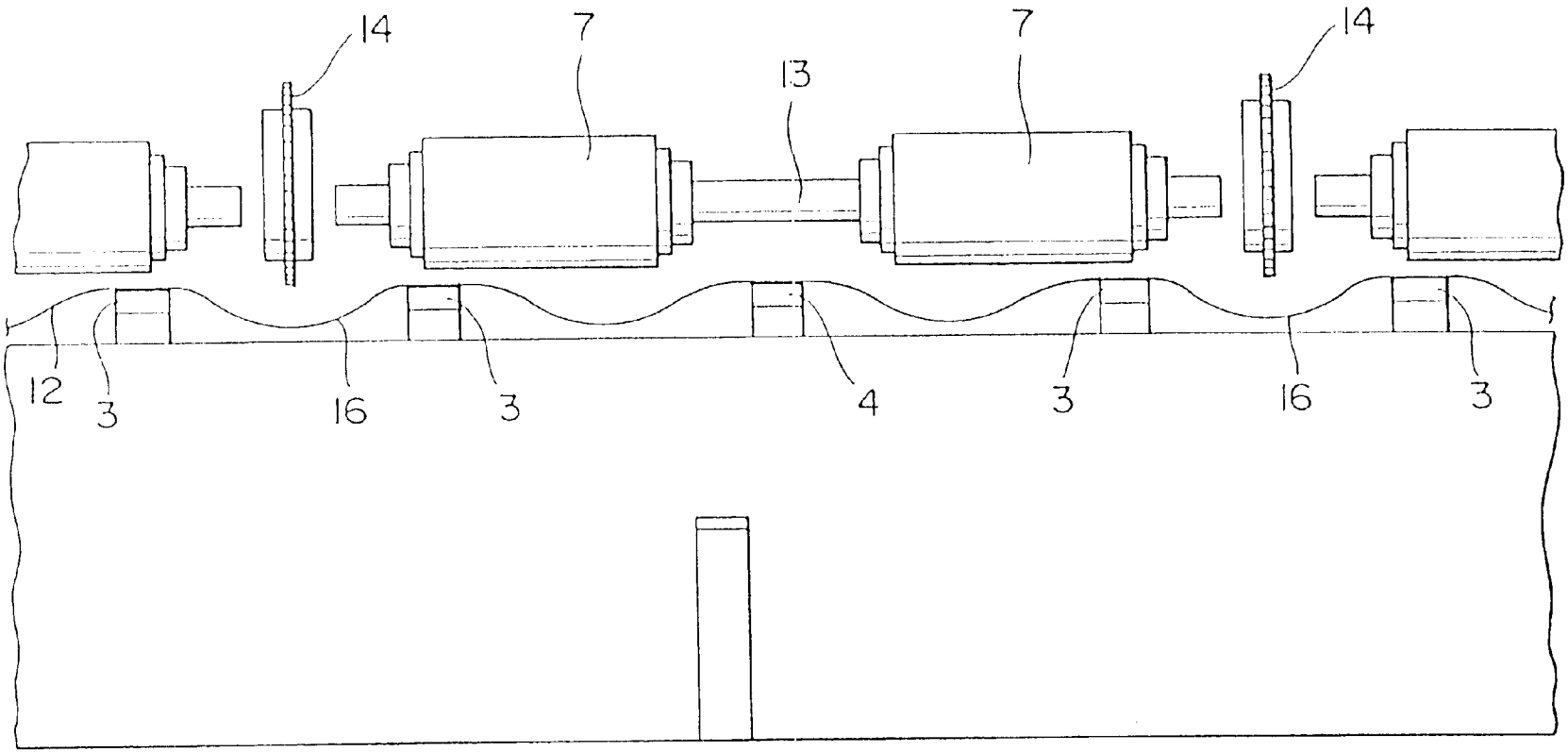
FIG. 5 is an enlarged plan view of the essential part of FIG. 4.

According to the embodiment, since the medium regulators 4 are disposed so that the positional relationship of the medium regulators 4 to the respective driven feeding rollers 7 may have predetermined regularity, the cockling interval of the paper can be made to substantially coincide with the pitch of the relevant medium regulator 4 by the nipping force of the feeding roller 5 and the relevant medium regulator 4 supporting from below the paper 12 affected by the nipping force. Thus the cockling interval becomes stabilized to ensure that the fear of staining the paper 12 with ink due to the swelling of the paper 12 toward the recording head face by cockling is decreased. In FIG. 5, reference numeral 16 indicates a valley portion of the cockled paper situated between the subregulators 3. As no relevant subregulator 3 exists in any position further upstream than that position, a gentle cockling valley is formed between the medium regulators 4.

As the flat top faces of the respective medium regulators 4 are extended beyond at least the range of the nozzle row (from #1 to #N) upstream, moreover, it is possible to force the paper 12 to cockle as desired before the paper 12 is wetted with ink. Therefore, when ink is landed on the paper 12 to be cockled, the paper 12 has been already cockled in the desired interval which has been predetermined by the medium regulators 4, so that the cockling interval is stabilized further.

Further, cockling is hardly produced with an interval of 20 mm or less in almost all kinds of paper 12. According to this embodiment, setting of the interval between the adjoining medium regulators 4 at 20 mm or greater makes it possible to smoothly generate cockling with the desired cockling interval.

As the subregulators 3 are disposed between the medium regulators 4 in such a position as to be opposed to the downstream side of the range of the nozzle row (from #1 to #N), the force of supporting from below the paper 12 by the relevant subregulators affects the area of the medium regulators positioned further upstream, and this results in decreasing the depth of the valley portion of cockling forcibly provided as described above. Therefore, the variation of the paper gap in the valley portion of cockling can be kept in a smaller range.

As the height of the subregulators 3 is set slightly smaller than that of the medium regulators 4, moreover, the influence of the primary function of the medium regulators 4 which forces the paper 12 to cockle with a predetermined interval is lowered.

As each of the discharging drive rollers 9 is disposed in such a manner that its position in the main scanning direction is coincident with that of the medium regulator 4, the cockling interval can be stabilized further.

The vicinity of the edge of the paper 12 abuts onto a medium regulator 4*a*, which is disposed so as to let the edge of the paper 12 abut onto its substantially central axis. The distance between the substantially central axis of the medium regulator 4*a* and the edge of the paper 12 should preferably be substantially the same. In other words, because the outermost valley portion of cockling is formed in a position close to the edge of the paper 12, a range of forcibly flattening the edge portion of the paper 12 is shortened. Thus a cockling shape similar to that of a mountain portion formed by the medium regulator 4 can be formed on the medium regulator 4*a*. Namely, the cockling shape can be uniformized over the whole width length of the paper 12.

Figure 6:
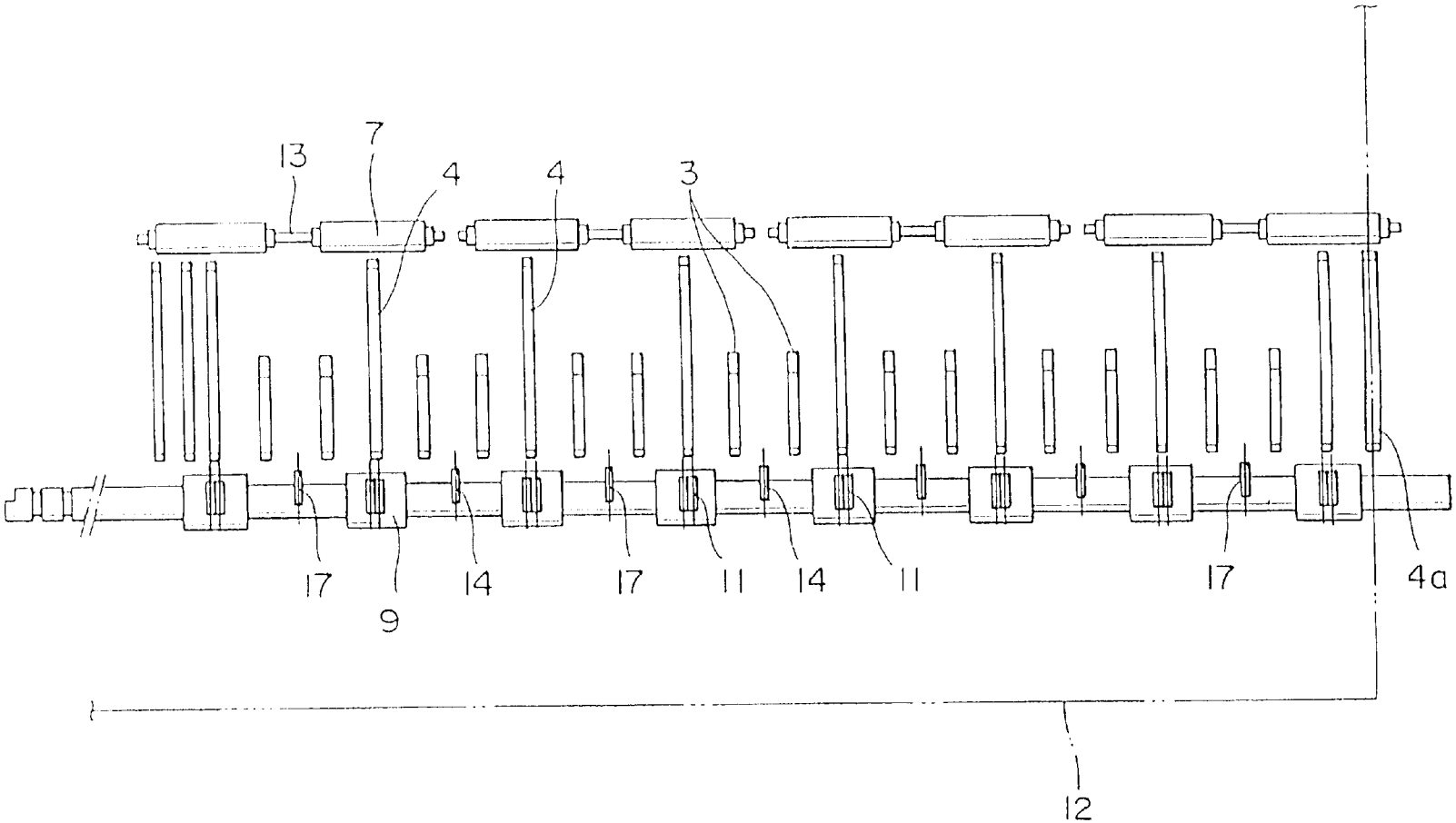
FIG. 6 is a plan view of the essential part of a dot recording apparatus according to a second embodiment of the present invention.

FIG. 6 shows a second embodiment of the present invention wherein medium regulators 4 are arranged in a position corresponding to the position of each driven feeding roller 7 with an interval of 28 mm. However, though driven discharging rollers 17 are different from the driven discharging rollers 14 in that each driven discharging roller 17 is disposed in the central portion of the shaft 13, the role of the driven discharging rollers 17 is basically the same as that of the driven discharging rollers 14. As the remainder construction of this embodiment is similar to that of the first embodiment, like reference numerals are given to like component parts and the description thereof will be omitted.

Figure 7:
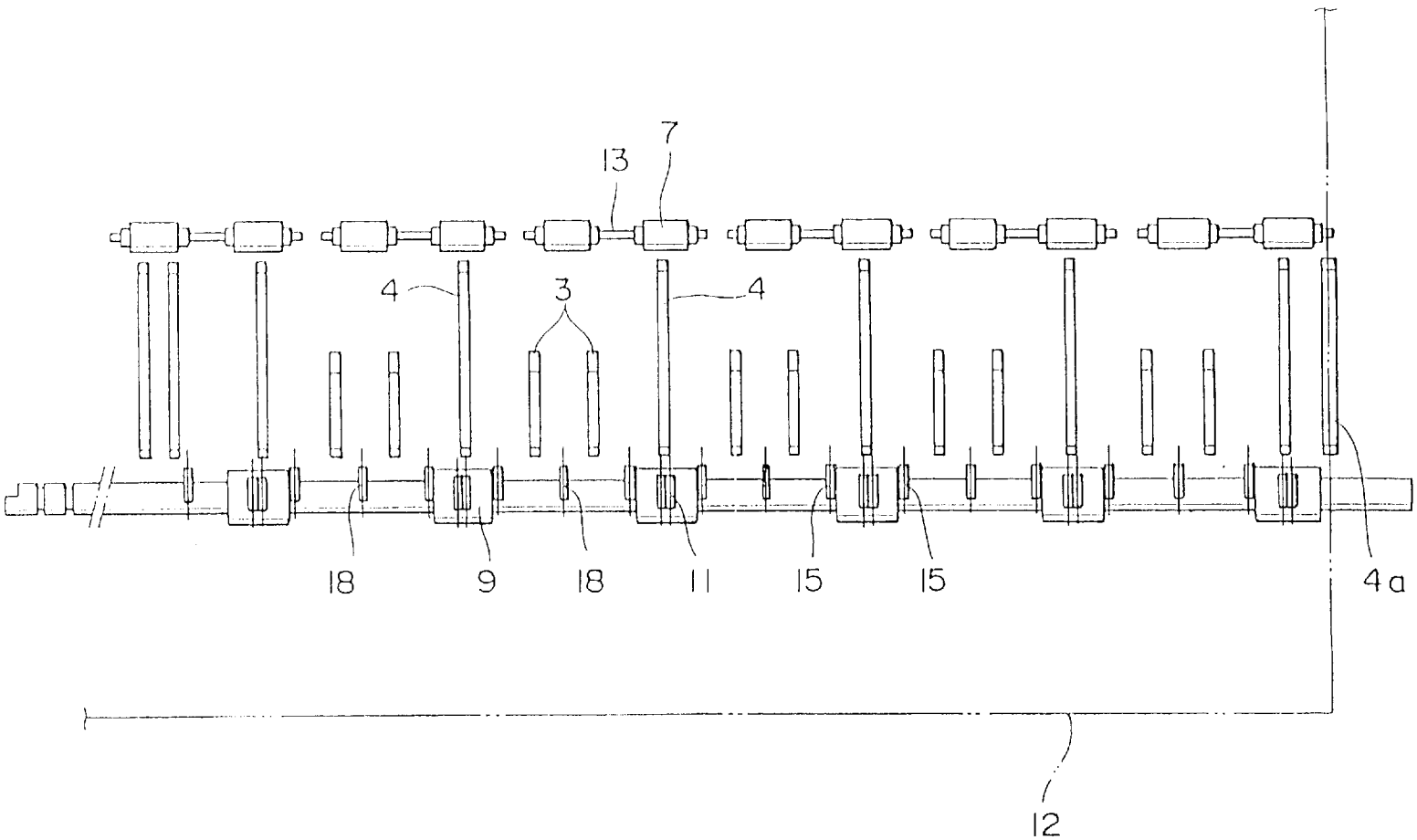
FIG. 7 is a plan view of the essential part of a dot recording apparatus according to a third embodiment of the present invention.

FIG. 7 shows a third embodiment of the present invention wherein medium regulators 4 are arranged in every other place corresponding to the position of each driven feeding roller 7 with an interval of 37 mm. However, though driven discharging rollers 18 are different from the driven discharging rollers 14 in that each of the driven discharging rollers 18 is disposed not in the central portion of the shaft but to the left thereof, the role of the driven discharging rollers 18 is basically the same as that of the driven discharging rollers 14. As the remainder construction of this embodiment is similar to that of the first embodiment, like reference numerals are given to like component parts and the description thereof will be omitted.

Figure 8:
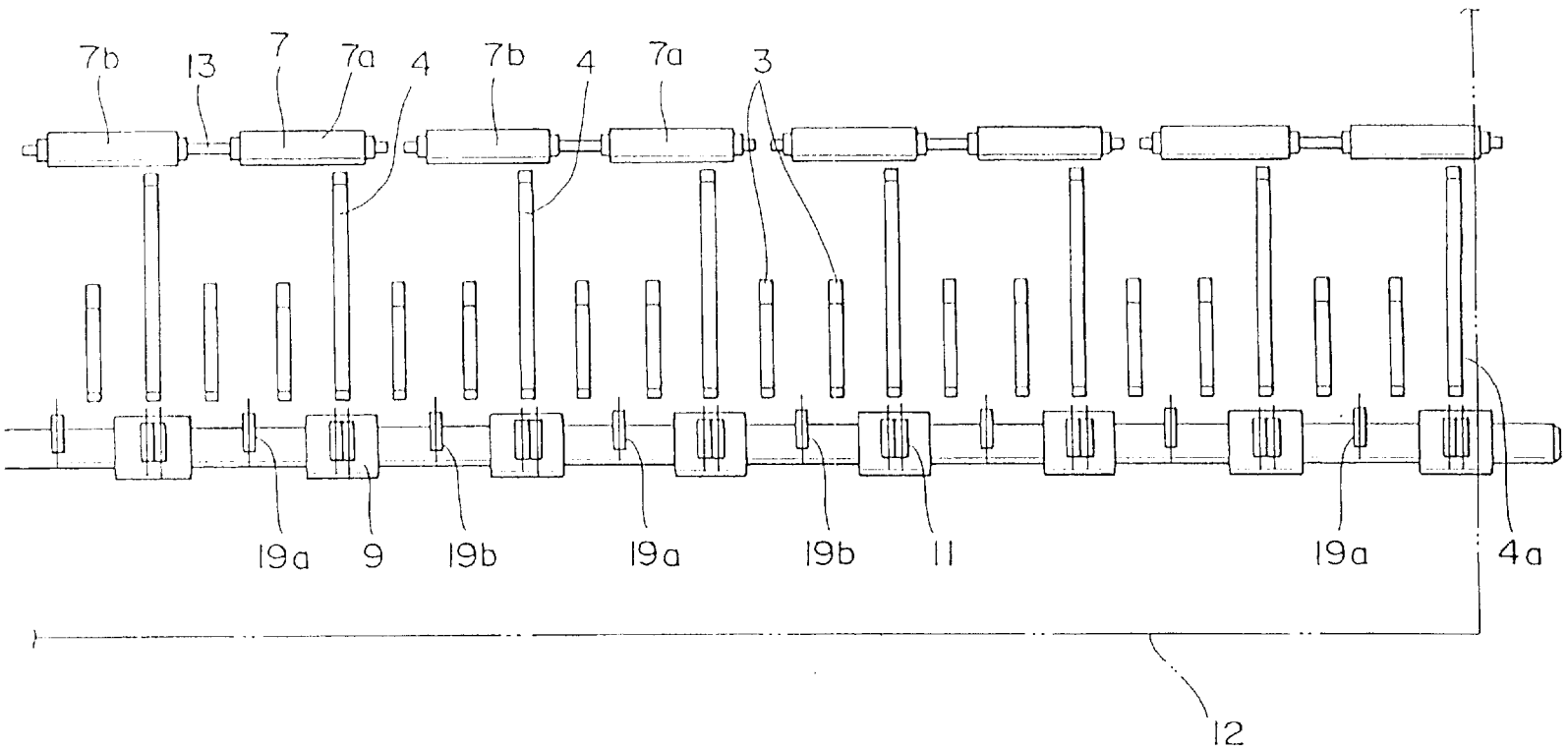
FIG. 8 is a plan view of the essential part of a dot recording apparatus according to a fourth embodiment of the present invention.

FIG. 8 shows a fourth embodiment of the present invention wherein medium regulators 4 are arranged in a position corresponding to the position of each driven feeding roller 7 with an interval of 28 mm. Although driven discharging rollers 19 shown by reference numerals 19*a* and 19*b* are different from the driven discharging rollers 14 in that each of the driven discharging rollers 19*a* is disposed to the left of a driven feeding roller 7*a* and that each of the driven discharging rollers 19*b* is disposed to the left of a driven feeding roller 7*b*, the role of the driven discharging rollers 19 is basically the same as that of the driven discharging rollers 14. Moreover, the medium regulator 4*a* is disposed slightly inward from the edge of the paper 12. As the remainder construction of this embodiment is similar to that of the first embodiment, like reference numerals are given to like component parts and the description thereof will be omitted.

Figure 9:
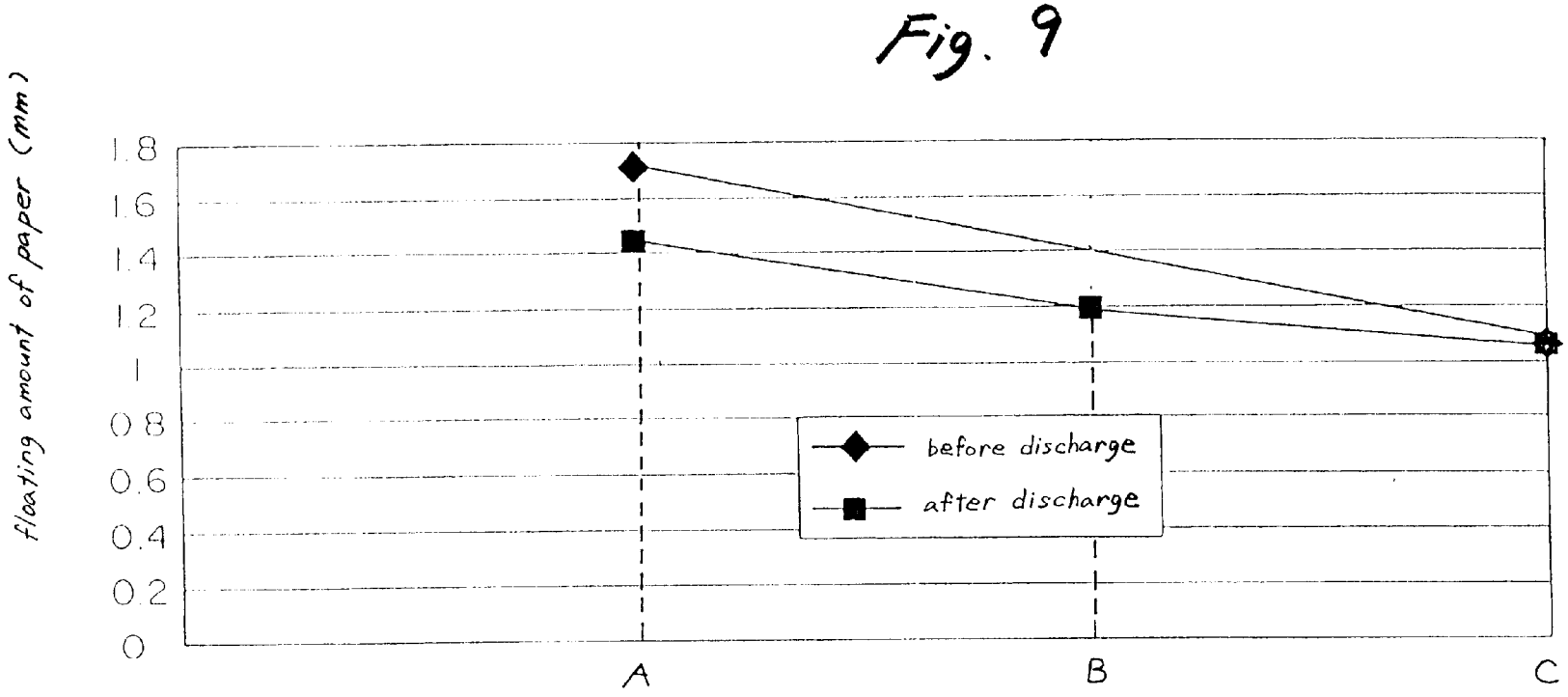
FIG. 9 is a graph showing floating amounts of paper in the related apparatus and the apparatus according to the present invention.

FIG. 9 is a graph showing floating amounts (ordinate axis) of paper in the related apparatus and the apparatus according to the present invention. In the graph, A shows the data derived from the related apparatus (interval between adjacent medium regulators; 32 mm). B shows the data derived from the apparatus according to the third embodiment of the invention (interval between adjacent medium regulators; 37 mm). Namely, in a case where the medium regulators 4 are disposed in the substantially central portion of the respective driven feeding rollers 7. C shows the data derived from the apparatus according to the first embodiment of the invention (interval between adjacent medium regulators; 37 mm). Namely, in a case where the medium regulators 4 are disposed between the driven feeding rollers.

As is obvious from the graph above, the cockling interval is stabilized and the floating amount caused by the undulating deformation of the paper 12 due to cockling becomes reduced according to the invention, whereby the probability of staining the paper 12 with ink as the paper 12 swells toward the head face side of the recording head 2 is seen to decrease.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A dot recording apparatus, comprising:

a recording head, having a head face on which at least one row of dot forming elements which form dots on a recording medium is arranged in a subscanning direction thereof;

a drive feeding roller, extending in a main scanning direction of the recording head;

a plurality of driven feeding rollers, arranged in the main scanning direction with a first predetermined interval, such that the recording medium is nipped between the drive feeding roller and the driven feeding rollers to be fed to the recording head; and a plurality of medium regulators, arranged in the main scanning direction with a second predetermined interval which is one of equal to or greater than the first predetermined distance, the medium regulators being opposed to the head face such that top faces of medium regulators define a distance between the recording medium carried thereon and the head face; wherein the first predetermined interval is a distance between centers of adjacent driven feeding rollers and the second predetermined interval is a distance between centers of adjacent medium regulators.

2. The dot recording apparatus as set forth in claim 1, wherein each of the medium regulators extend in the subscanning direction such that the top faces extend beyond to an upstream end of the dot row of the dot forming elements.

3. The dot recording apparatus as set forth in claim 1, wherein the predetermined interval of the medium regulator is 20 mm or more.

4. The dot recording apparatus as set forth in claim 1, further comprising a subregulator, disposed between the respective adjacent medium regulators at an area opposed to a downstream side of the head face to support the recording medium together with the medium regulators.

5. The dot recording apparatus as set forth in claim 4, wherein a top face of the subregulator is not higher than the top face of the medium regulator.

6. The dot recording apparatus as set forth in claim 1, further comprising a plurality of discharging roller pairs for discharging the recording medium on which dots are recorded by the recording head, wherein each of the discharging roller pairs and the associated medium regulator are situated on the same line which extends in the subscanning direction.

7. The dot recording apparatus as set forth in claim 1, wherein each of the medium regulators is offset from a center of an associated driven feeding roller with respect to the main scanning direction.

8. The dot recording apparatus as set forth in claim 1, wherein the outermost medium regulator is disposed such that a side edge of the recording medium is placed on a substantially center portion in the main scanning direction of the top face thereof.

9. A dot recording apparatus, comprising:

a recording head, having a head face on which at least one row of dot forming elements which form dots on a recording medium is arranged in a subscanning direction thereof:

a drive feeding roller, extending in a main scanning direction of the recording head;

a plurality of driven feeding rollers, arranged in the main scanning direction with a first predetermined interval, such that the recording medium is nipped between the drive feeding roller and the driven feeding rollers to be fed to the recording head; and a plurality of medium regulators, arranged in the main scanning direction with a second predetermined interval which is associated with the arrangement of the driven feeding rollers, the medium regulators being opposed to the head face such that top faces of medium regulators define a distance between the recording medium carried thereon and the head face, wherein two adjacent driven feeding rollers are connected with a shaft which extends in the main scanning direction to form a driven feeding roller unit; and wherein each of the medium regulators and a center portion in the main scanning direction of the shaft in each of the driven feeding roller units are situated on the same line which extends in the subscanning direction.

10. The dot recording apparatus as set forth in claim 9, wherein the second predetermined interval is one of equal to or greater than the first predetermined distance.

11. A dot recording apparatus, comprising:

a recording head, having a head face on which at least one row of dot forming elements which form dots on a recording medium is arranged in a subscanning direction thereof:

a drive feeding roller, extending in a main scanning direction of the recording head;

a plurality of driven feeding rollers, arranged in the main scanning direction with a first predetermined interval, such that the recording medium is nipped between the drive feeding roller and the driven feeding rollers to be fed to the recording head; and a plurality of medium regulators, arranged in the main scanning direction with a second predetermined interval which is associated with the arrangement of the driven feeding rollers, the medium regulators being opposed to the head face such that top faces of medium regulators define a distance between the recording medium carried thereon and the head face, wherein each of the medium regulators and a center portion in the main scanning direction of the associated driven feeding roller are situated on the same line which extends in the subscanning direction.

12. The dot recording apparatus as set forth in claim 11, wherein the second predetermined interval is one of equal to or greater than the first predetermined distance.

13. A dot recording apparatus, comprising:

a recording head, having a head face on which at least one row of dot forming elements which form dots on a recording medium is arranged in a subscanning direction thereof:

a drive feeding roller, extending in a main scanning direction of the recording head;

a plurality of driven feeding rollers, arranged in the main scanning direction with a first predetermined interval, such that the recording medium is nipped between the drive feeding roller and the driven feeding rollers to be fed to the recording head; and a plurality of medium regulators, arranged in the main scanning direction with a second predetermined interval which is associated with the arrangement of the driven feeding rollers, the medium regulators being opposed to the head face such that top faces of medium regulators define a distance between the recording medium carried thereon and the head face, wherein each of the medium regulators and a center portion in the main scanning direction of every other driven feeding roller are situated on the same line which extends in the subscanning direction.

14. The dot recording apparatus as set forth in claim 13, wherein the second predetermined interval is one of equal to or greater than the first predetermined distance.

15. A dot recording apparatus, comprising:

a recording head, having a head face on which at least one row of dot forming elements which form dots on a recording medium is arranged in a subscanning direction thereof:

a drive feeding roller, extending in a main scanning direction of the recording head;

a plurality of driven feeding rollers, arranged in the main scanning direction with a first predetermined interval, such that the recording medium is nipped between the drive feeding roller and the driven feeding rollers to be fed to the recording head; and a plurality of medium regulators, arranged in the main scanning direction with a second predetermined interval which is associated with the arrangement of the driven feeding rollers, the medium regulators being opposed to the head face such that top faces of medium regulators define a distance between the recording medium carried thereon and the head face, wherein two adjacent driven feeding rollers are connected with a shaft which extends in the main scanning direction to form a driven feeding roller unit; and wherein each of the medium regulators and an associated portion between the adjacent driven feeding roller units are situated on the same line which extends in the subscanning direction.

16. The dot recording apparatus as set forth in claim 15, wherein the second predetermined interval is one of equal to or greater than the first predetermined distance.

17. A dot recording apparatus, comprising:

a recording head, having a head face on which at least one row of dot forming elements which form dots on a recording medium is arranged in a subscanning direction thereof;

a drive feeding roller, extending in a main scanning direction of the recording head;

a plurality of driven feeding rollers, arranged in the main scanning direction with a first predetermined interval, such that the recording medium is nipped between the drive feeding roller and the driven feeding rollers to be fed to the recording head;

a plurality of medium regulators, arranged in the main scanning direction with a second predetermined interval which is one of equal to or greater than the first predetermined distance, the medium regulators being opposed to the head face such that top faces of medium regulators define a distance between the recording medium carried thereon and the head face; and a subregulator disposed between the respective adjacent medium regulators at an area opposed to a downstream side of the head face to support the recording medium together with the medium regulators.

18. The dot recording apparatus as set forth in claim 17, wherein a top face of the subregulator is not higher than the top face of the medium regulator.

* * * * *